United States Patent [19]

Komossa et al.

[11] 4,401,205

[45] Aug. 30, 1983

[54] APPARATUS FOR SUPPLYING PARTICLES OF TOBACCO TO THE COMMINUTING STATION OF A SHREDDING MACHINE

[75] Inventors: Werner Komossa, Börnsen; Gerhard Ramsch, Hamburg, both of Fed. Rep. of Germany

[73] Assignee: Hauni-Werke Körber & Co. KG, Hamburg, Fed. Rep. of Germany

[21] Appl. No.: 220,096

[22] Filed: Dec. 24, 1980

[30] Foreign Application Priority Data

Jan. 4, 1980 [DE] Fed. Rep. of Germany ..... 3000153

[51] Int. Cl.[3] ..... B65G 43/08; B65G 47/20

[52] U.S. Cl. ..... 198/524; 100/94; 100/151; 198/577; 241/34; 241/223

[58] Field of Search ..... 198/789, 347, 572, 577, 198/604–605, 627, 628, 524; 241/223, 34; 100/94–97, 151

[56] References Cited

U.S. PATENT DOCUMENTS

| | | | |
|---|---|---|---|
| 2,712,377 | 7/1955 | Eggleston | 198/789 |
| 3,185,196 | 5/1965 | Ward | 241/223 X |
| 4,172,515 | 10/1979 | Wochnowski | 241/34 X |
| 4,244,382 | 1/1981 | Thiele et al. | 198/572 |
| 4,303,366 | 12/1981 | Hinchcliffe et al. | 198/347 X |

*Primary Examiner*—Robert C. Watson
*Assistant Examiner*—Douglas D. Watts
*Attorney, Agent, or Firm*—Kontler, Grimes & Battersby

[57] ABSTRACT

A tobacco shredding machine wherein an upright duct delivers particles of tobacco to the rear portion of a channel wherein the particles are converted into a continuous cake whose front end is severed by a set of orbiting knives. The lower rear portion of the duct contains a deflecting conveyor which diverts the oncoming tobacco particles from a vertical path into a horizontal path and drives the oncoming particles at a speed which is a multiple of the speed of tobacco compacting conveyors flanking the channel. The speed of the deflecting conveyor is changed in response to changes in the height of the opening between the stationary and movable sections of a mouthpiece through which the cake passes on its way into the range of the oribiting knives. This ensures that the height of the opening reassumes its normal value without changing the speed of the compacting conveyors. The deflecting conveyor is installed in a support which is removably insertable between the side walls of the duct.

44 Claims, 6 Drawing Figures

APPARATUS FOR SUPPLYING PARTICLES OF TOBACCO TO THE COMMINUTING STATION OF A SHREDDING MACHINE

BACKGROUND OF THE INVENTION

The present invention relates to tobacco cutting or shredding machines in general, and more particularly to improvements in tobacco cutting machines of the type wherein a continuous condensed cake of tobacco particles is advanced into the range of one or more orbiting knives at a severing or comminuting station so that the leader of the cake is converted into shreds or analogous fragments of tobacco. Still more particularly, the invention relates to improvements in apparatus for supplying particles of tobacco (e.g., tobacco leaf laminae or tobacco ribs) to the unit which converts the particles into a continuous cake.

It is well known to compress or compact particles of tobacco between the lower reach of an upper endless chain or belt conveyor and the upper reach of a lower endless chain or belt conveyor. The two reaches are inclined with reference to each other so that the height of the channel which is defined by such compacting conveyors decreases in a direction toward the comminuting station. The tobacco discharging end of the channel is adjacent to a mouthpiece through which the leader of the cake advances into the range of the orbiting knife or knives. The receiving or rear end of the channel is disposed above a rearwardly extending rear portion of the upper reach of the lower compacting conveyor and receives tobacco from the lower end portion of a duct the upper end portion of which receives non-compacted tobacco from a main source of supply, e.g., from a hopper for tobacco ribs or tobacco leaf laminae. As a rule, the channel is substantially horizontal and the duct defines a substantially vertical passage for advancement of the lower end of a pile of tobacco particles toward the receiving end of the channel. Reference may be had to commonly owned U.S. Pat. No. 4,037,712 granted July 12, 1977 to Wochnowski.

It is also known to provide the duct with a deflecting device which forms part of or is adjacent to the lower portion of the aforementioned passage and serves to promote the advancement of particles of tobacco toward the receiving end of the channel, i.e., onto the rear portion of the lower compacting conveyor. A deflecting device in the form of an oscillating rake is disclosed in commonly owned U.S. Pat. No. 4,149,547 granted Apr. 17, 1979 to Komossa et al.

The quality of shreds of otherwise configurated fragments which are formed at the comminuting station is satisfactory if the density of each and every portion or zone of the cake is constant. This enhances the comminuting acton of the orbiting knife or knives and reduces the likelihood that the knife or knives would extract entire laminae and/or ribs, i.e., that the knife or knives would fail to carry out a desirable and uniform comminuting action upon each and every particle in the cake. Uniform compacting of particles which form the cake can be accomplished by ensuring the delivery of tobacco particles at a constant rate, preferably by ensuring that the density of particles in the duct is constant and also that the height of the supply or pile of particles in the duct is at least nearly constant.

A critical zone of a tobacco shredding machine of the type wherein particles of tobacco descend in an upright duct toward and into a substantially horizontal compacting or condensing channel is that region where the direction of particles is changed from vertical or nearly vertical to horizontal or nearly horizontal. Any interruption of the mass of tobacco particles in such zone is likely to lead to the formation of an unsatisfactory cake which exhibits voids or wherein portions of greater density alternate with portions of lesser density. The change of direction of tobacco particles in the aforementioned critical zone is quite pronounced (normally approximately 90 degrees). In the absence of satisfactory feed of tobacco into the horizontal channel, the cake develops wedge-like voids which are not filled at all or which are filled only in part before the respective portion of the cake reaches the comminuting station. Unsatisfactory densification of the cake enables the orbiting knife or knives at the severing or comminuting station to extract entire tobacco leaf portions without any comminution or shredding. Absence of uniform density in all regions of the cake which is being shredded is the main cause of the formation of unsatisfactory shreds.

OBJECTS AND SUMMARY OF THE INVENTION

An object of the invention is to provide a tobacco cutting or shredding machine with a novel and improved apparatus for supplying tobacco to the comminuting station of the machine in such a way that the density of the mass of tobacco particles which are severed at this station is constant or deviates only negligibly from an optimum value.

Another object of the invention is to provide an apparatus of the just outlined character which is constructed and assembled in such a way that it can automatically compensate for undesirable influence of variable parameters, such as changes in temperature or moisture content of tobacco, so that the density of the mass which is about to be shredded rapidly returns to the desired value even if such density temporarily deviates from the optimum value.

A further object of the invention is to provide the tobacco feeding apparatus with novel and improved means for controlling the movements of tobacco particles in the region where the direction of travel of particles undergoes a pronounced change, particularly a change from travel in a substantially vertical direction to travel in a substantially horizontal direction.

An additional object of the invention is to provide an apparatus which is sufficiently versatile to allow for optimum compacting of a wide variety of tobaccos and which can be rapidly converted for the processing of different tobacco types.

Another object of the invention is to provide a novel and improved tobacco deflecting conveyor which can be installed in a tobacco shredding machine to enhance the development of a tobacco cake whose density is constant even if one or more variable parameters which normally detract from uniformity of such density fluctuate within a rather wide range.

An ancillary object of the invention is to provide the above outlined apparatus with novel and improved means for effecting at least some preliminary densification of tobacco even before the particles of tobacco reach the actual compacting or densifying zone.

The invention is embodied in an apparatus for supplying particles of tobacco to the comminuting or shredding station of a tobacco cutting or shredding machine. The apparatus comprises a pair of preferably superimposed tobacco advancing and compacting conveyors which preferably include an endless upper conveyor and an endless lower conveyor and define an elongated substantially horizontal channel whose tobacco receiving end is remote from and whose tobacco discharging end is adjacent to the comminuting station, a variable-speed motor or other suitable means for driving at least one of the conveyors at a constant or variable first speed and in a direction to advance the particles of tobacco entering the channel by way of the receiving end toward and beyond the discharging end (i.e., into the range of one or more orbiting severing tools or knives at the comminuting station), and novel and improved means for feeding particles of tobacco to the receiving end of the channel. The tobacco feeding means comprises a substantially upright duct which is disposed above the channel and has a tobacco admitting upper portion and a tobacco discharging lower portion adjacent to the receiving end of the channel. The duct includes a front wall which is nearer to and a rear wall which is more distant from the comminuting station. The rear wall includes a tobacco deflecting conveyor and an electric motor or other suitable means for driving the deflecting conveyor in a direction to advance particles of tobacco from the interior of the duct toward the receiving end of the channel at a second speed which exceeds the first speed.

The lower compacting conveyor preferably includes a rear portion which extends beyond the upper conveyor, as considered in a direction from the discharging end toward the receiving end of the channel (i.e., as considered in a direction away from the comminuting station), and the lower portion of the duct is preferably disposed above the rear portion of the lower conveyor. The drive means for the deflecting conveyor is preferably a continuously running motor so that the deflecting conveyor uninterruptedly delivers particles of tobacco into the receiving end of the channel whenever the apparatus is in actual use.

The second speed is preferably a multiple of (most preferably approximately three times) the speed of the compacting conveyors.

The compacting conveyors may constitute endless chain or belt conveyors, and the lower compacting conveyor has an elongated tobacco-engaging and advancing portion (this is the upper reach of the endless lower conveyor) which makes an oblique angle with an elongated tobacco-engaging and advancing portion of the deflecting conveyor. The oblique angle is preferably an acute angle, for example, an angle of approximately 45 degrees.

The apparatus preferably comprises a self-sustaining support or skeleton frame for the deflecting conveyor and its drive means. Such self-sustaining support (together with the deflecting conveyor and the drive means for the deflecting conveyor) preferably constitutes a first portion of the duct and the latter then preferably comprises a second portion which defines a compartment for and separably (removably) receives the first portion. The first portion can be separably secured to a pair of spaced apart side walls which constitute components of the second portion of the duct and extend rearwardly of the front wall, i.e., in a direction away from the comminuting station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
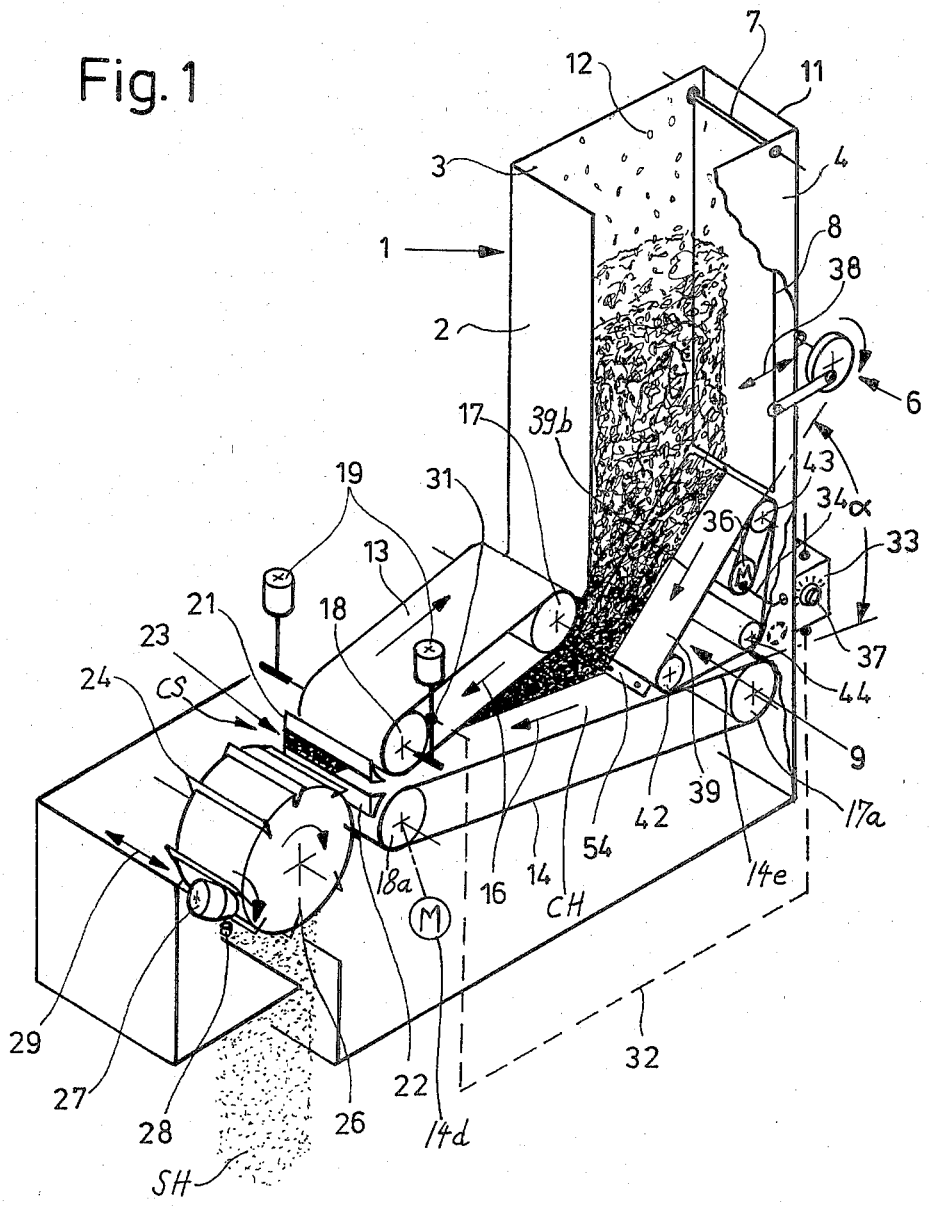
FIG. 1 is a perspective view of an apparatus which embodies one form of the invention, with a portion of the housing broken away to reveal the interior of the duct and the channel for transport of the cake toward the severing station.

Referring first to FIG. 1, there is shown a tobacco cutting or shreeding machine which resembles a machine of the type known as "KT" manufactured and sold by the assignee of the present application. The machine comprises a tobacco accumulating duct 1 which includes a front wall 2, two side walls 3 and 4, and a composite rear wall including (a) a rake 8 which is pivotable about the axis of a horizontal shaft 7 mounted close to the upper end of and at the inner side of a covering panel 11 and (b) a tobacco deflecting conveyor 9 which is disposed below the rake 8 and serves to steer particles of tobacco into a substantially horizontal channel CH between the lower reach of an upper endless tobacco advancing and compacting conveyor 13 and the upper reach of a lower endless tobacco advancing and compacting conveyor 14. The upper reach of the conveyor 14 has a rear portion **14*e* which receives tobacco particles traveling along the exposed side of the deflecting conveyor 9**.

The rake 8 is swingable forwardly and backwards by an eccentric drive 6 so that it performs movements in directions indicated by a double-headed arrow 38. The panel 11 overlies the rear side of the rake 8 as well as the rear side of the deflecting conveyor 9 and is connected to or forms part of a base of the tobacco cutting machine. The reference character 12 denotes particles of tobacco (e.g., tobacco leaf laminae) which are supplied into the upper end of the duct 1, for example, in a manner as disclosed in the aforementioned U.S. Pat. No. 4,037,712 or in the commonly owned U.S. Pat. No. 4,172,515 granted Oct. 30, 1979 to Wochnowski. The disclosures of these two patents to Wochnowski are incorporated herein by reference to provide a full disclosure of the means which supplies tobacco to the duct 1.

The duct 1 is substantially vertical (upright), and the channel CH is substantially horizontal even though the lower reach of the upper compacting conveyor 13 slopes downwardly and forwardly with reference to the essentially horizontal upper reach of the lower compacting conveyor 14. The rear portion 14*e* of the upper reach of the lower compacting conveyor 14 is located at a level below the lower end of the duct 1. The conveyors 13 and 14 are preferably endless chains which are respectively trained over front and rear sprocket wheels 18, 18*a* and 17, 17*a*. The arrow 16 indicates the direction of advancement of the growing cake of tobacco particles 12 toward the severing or comminuting station CS, namely, toward a mouthpiece 23 which includes a mobile upper section 21 and a stationary lower section 22.

The shaft (not specifically identified) for the rear sprocket wheel 17 of the upper compacting conveyor 13 is journalled in a stationary portion of the frame of the cutting machine in a manner not specifically shown in FIG. 1. The shaft for the front sprocket wheel 18 of the upper compacting conveyor 13 is movable up and down, together with the upper section 21 of the mouthpiece 23, so as to enable the upper compacting conveyor 13 to yield when the density and thickness of the cake in the channel CH rise to a predetermined value. The shaft for the sprocket wheel 18 at the front end of the upper conveyor 13 can be installed in suitable arcuate slots of two spaced apart frame members and is biased downwardly by a composite biasing device, e.g., a pair of dashpots 19. The biasing device causes or enables the axis of the front sprocket wheel 18 to travel along an arc whose center of curvature is located on the axis of the rear sprocket wheel 17.

The lower section 22 of the mouthpiece 23 is fixedly mounted in the base of the machine frame and constitutes a counterknife for the orbiting knives 24 on a rotary drum-shaped holder 26. The latter is installed in front (i.e., at the discharge end) of the channel CH so that its knives 24 cooperate with the counterknife 22 to convert the leader of the cake into shreds SH which are evacuated by a suction conveyor (not shown), for example, in a manner as shown schematically in the aforementioned patents to Wochnowski. The cutting edges of the knives 24 are sharpened by a grinding tool 27 which is reciprocable (see the arrow 29) in parallelism with the axis of the holder 26 and whose grinding wheel is dressed by a diamond 28 or the like. The means for rotating the holder 26 (such means preferably includes a discrete electric motor) is not shown in FIG. 1.

The means for driving the compacting conveyors 13 and 14 comprises a discrete prime mover 14*d*, preferably an electric motor which is installed in, on or adjacent to the base of the machine frame and transmits torque to one of the sprocket wheels, for example, to the front sprocket wheel 18*a* of the lower compacting conveyor 14. The latter drives the upper compacting conveyor 13, e.g., through the medium of a gear train in a manner as shown and described in the patents to Wochnowski or in the aforementioned commonly owned U.S. Pat. No. 4,179,547 to Komossa et al. If desired, the prime mover 14*d* which drives the compacting conveyors 13, 14 can also transmit torque to the holder 26 for the orbiting knives 24 and/or to the means for rotating and reciprocating the grinding tool 27.

The machine further comprises means for monitoring the width of the opening which is defined by the mouthpiece 23, i.e., the distance between the mobile section 21 and the stationary section or counterknife 22 of this mouthpiece. Suitable monitoring and control means are shown and described, for example, in the German-language publication entitled "Beiträge zum Stand der Technik in der tabakverarbeitenden Industrie", Article 1, Volume 2/1969, Seventh Year of Publication, June 1, 1969. The illustrated monitoring means includes a schematically shown level detector 31 which is movable up and down with or is adjacent to the path of movement of the sprocket wheel 18 and transmits signals denoting the distance between the mouthpiece sections 21 and 22. Such signals are transmitted via conductor means 32 which is indicated by a broken line and is connected to the input of a control unit 33. Alternatively, the detector 31 may receive impulses from one dashpot 19 of the biasing device for the sprocket wheel 18, e.g., the detector may include a transducer which generates an electric signal whose intensity or another characteristic is indicative of the force with which the biasing means opposes lifting of the front sprocket wheel 18 above and away from the front sprocket wheel 18*a*. The control unit 33 is connected with the drive means 36 (e.g., a variable-speed electric motor) for the endless tobacco transporting element 39 of the deflecting conveyor 9. Thus, the speed of the tobacco-engaging reach 39*a* (see FIG. 2) of the element 39 can be regulated as a function of the height of the leading end of compacted tobacco cake in the channel CH. The operative connection between the control unit 33 and the motor or drive means 36 includes conductor means 34. The reference character 37 denotes a rotary knob which can be manipulated by hand so as to enable an attendant to manually adjust the speed of the prime mover 33 when the attendant desires to change such speed independently of the intensity or another characteristic of the signal which is transmitted via conductor means 32.

The duct 1 is further equipped or associated with means for monitoring the upper level of the pile of tobacco particles 12 therein and for transmitting signals which regulate the operation of tobacco supplying means, i.e., of the means which delivers particles to the upper end of the duct 1. This ensures that the height of the tobacco pile in the duct 1 is constant or nearly constant (at any rate, the height remains within a preselected and preferably relatively narrow range) to contribute to uniformity of the cake which is formed on the upper reach of the lower compacting conveyor 14. Alternatively, the detector means (preferably a battery of two or more photoelectric cells) for monitoring the height of the tobacco pile in the duct 1 may serve for generation of signals which are used to regulate the speed of the prime mover 14*d*, i.e., of the means for driving the compacting conveyors 13, 14 or the compacting conveyors 13, 14 and the holder 26. Such detector means is fully described and shown in the aforementioned patents to Wochnowski.

In accordance with a feature of the invention, the speed of the prime mover 36 for the endless flexible element 39 of the deflecting conveyor 9 is invariably higher than the speed of the compacting conveyors 13 and 14. In fact, the speed of the flexible element 39 is preferably several times the speed of the compacting conveyors 13, 14. A presently preferred ratio of such speeds is approximately three-to-one. Thus, the particles 12 which descend in the duct 1 by gravity and also under the action of the oscillating rake 8 (note the eccentric drive 6) can move at a speed which is several times the speed of the compacting conveyors 13, 14 when such articles approach the rear portion 14*e* of the upper reach of the lower compacting conveyor 14. As explained above, and as shown in FIG. 1, the rear portion 14*e* of the upper reach of the compacting conveyor 14 extends rearwardly beyond the sprocket wheel 17 and is thus located below the lower end of the duct 1. The flexible element 39 of the deflecting conveyor 9 can accelerate at least some of the particles 12, i.e., those particles which descend in the rear zone of the duct 1 so that they travel in close proximity of the rake 8 and are engaged by the forwardly and downwardly sloping portion or reach 39*a* of the flexible element 39 whose speed is much higher than the speed of the rear portion 14*e*. Such pronounced acceleration of at least some of the particles 12 in the deflecting zone where the direction of travel of tobacco particles is changed from vertical to horizontal ensures that the mass of tobacco which advances from the interior of the duct 1 toward the mouthpiece 23 is not interrupted. Moreover, such acceleration greatly reduces (and practically eliminates) the likelihood of development of cavities or voids in the mass of tobacco particles 12. The mass undergoes a continuous and progressing densifying or compacting action, first in the duct 1 but primarily and very pronouncedly during conversion of such mass into a progressively thinner but denser cake which is caused to move in the channel CH (arrow 16) toward and through the mouthpiece 23 so that its leader is converted into shreds SH.

As soon as the height or width of the opening which is defined by the mouthpiece 23 changes, i.e., as soon as the distance between the stationary mouthpiece section or counterknife 22 and the mobile mouthpiece section 21 changes (even very slightly), the speed of the prime mover 36 also changes. Such changes of the height of the leader of the cake in the channel CH can be caused by variations of the moisture content of tobacco particles 12 and/or for other reasons (e.g., failure of the system which supplies particles of tobacco to the duct 1 and the resulting deceleration of the prime mover 14*d*). If the height of the leader of the tobacco cake in the channel CH decreases, the speed of the endless flexible element 39 of the deflecting conveyor 9 is increased to initiate an increase in the rate of tobacco delivery into the channel CH, i.e., to ensure that the quantity of tobacco per unit length of the cake will continue to match or at least closely approximate a desired optimum value. Inversely, the speed of the flexible element 39 will be reduced when the distance between the sections 21, 22 of the mouthpiece 23 increases, i.e., when the height of the leader of the cake in the channel CH increases beyond the desired optimum height. In addition to the aforementioned reasons, the height of the leader of the cake in the channel CH can change as a direct result of a reduction or an increase of the speed of the compacting conveyors 13, 14, in response to changes of temperature of tobacco particles which form the cake and/or in response to changes in the ratio of two or more tobacco types which form the pile in the duct 1. For example, the pile in the duct 1 may be composed of oriental tobacco and Burley, of oriental tobacco and Virginia and/or of any other suitable mixture of two or more tobacco types. Any changes of the distance between the sections 21, 22 of the mouthpiece 23 are detected by the monitoring means 31, and the conductor means 32 then transmits a signal (or a modified signal) which causes or enables the control unit 33 to change the speed of the prime mover 36 via conductor means 34. Even minor changes of the speed of the prime mover 36 (so that the speed of the endless flexible element 39 increases above or drops below the presently preferred speed, namely, approximately three times the speed of the compacting conveyors 13, 14) suffices to conform the rate of tobacco delivery from the duct 1 into the channel CH to changes of the height of the leader of tobacco cake. Changes of the speed of the prime mover 36 entail automatic changes in the position of the mobile mouthpiece section 21 relative to the stationary section 22, i.e., the height of the opening which is defined by the mouthpiece 23 rapidly reassumes the desired or optimum value. In other words, and since the height of such opening denotes or contributes to the quality of the shreds, adjustments of the speed of the deflecting conveyor 9 in response to signals which are transmitted via conductor means 32 ensure that adverse effects of temperature changes of tobacco, changes of moisture content of tobacco, changes in the rate of supply of tobacco particles to the duct 1, changes in the speed of the compacting conveyors 13, 14 and/or of other unpredictable parameters can be compensated for in a fully automatic way and with a surprisingly high degree of accuracy. The automatic adjustment is or can be effective within any desired range of outputs of the tobacco cutting machine, i.e., the selected or desired height of the opening between the sections 21 and 22 of the mouthpiece 23 will remain unchanged or, if changed in response to unpredicatable reasons, will be reestablished practically without any delay to thus guarantee that the shredding action will at least approach the optimum shredding action.

Figure 2:
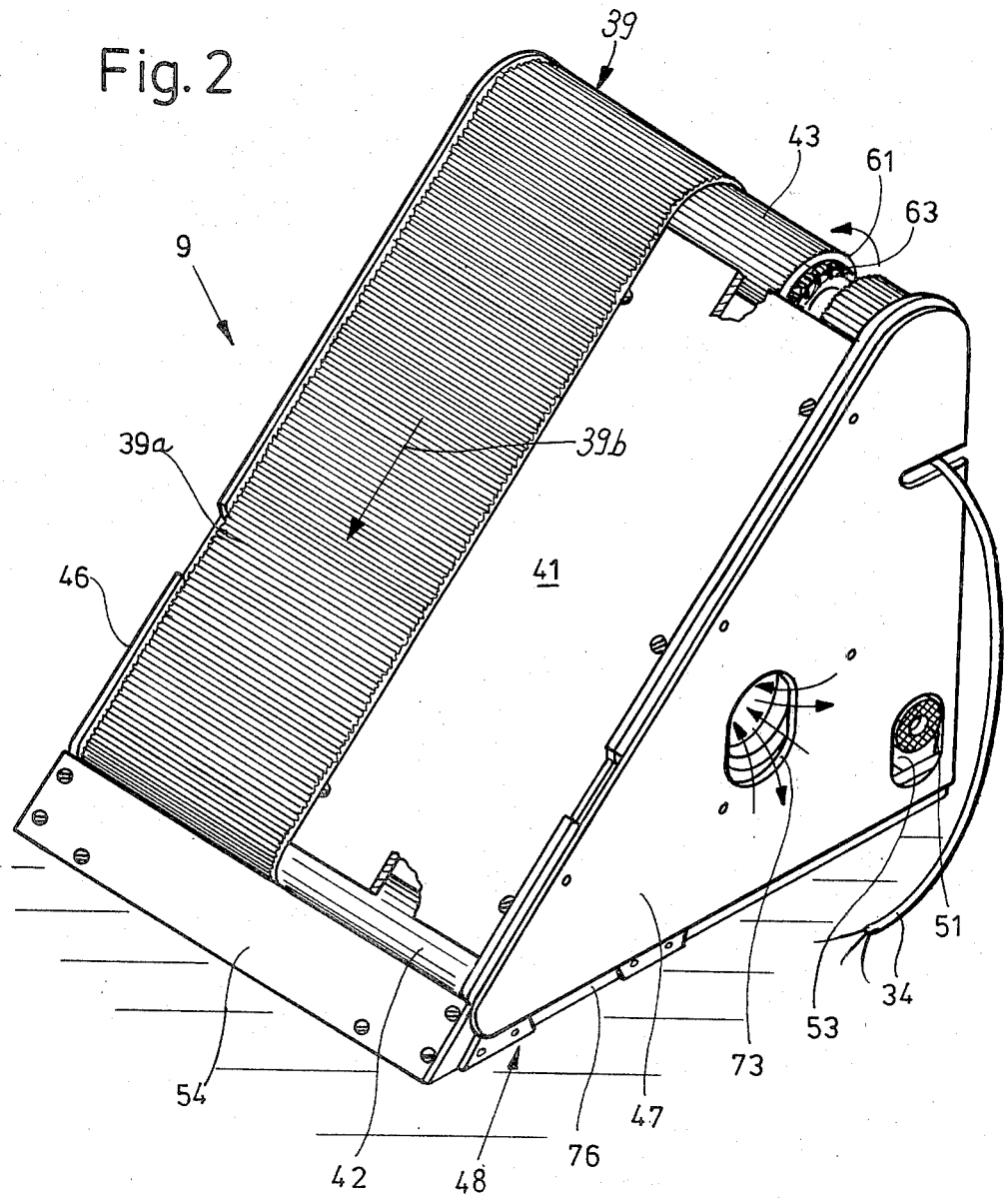
FIG. 2 is an enlarged perspective view of a unit which includes the tobacco deflecting conveyor in the duct of the apparatus of FIG. 1 and the drive means for such deflecting conveyor.

FIG. 2 illustrates in greater detail one presently preferred embodiment of the deflecting conveyor 9. The endless flexible element 39 of this conveyor is a relatively wide band or belt having a roughened (e.g., corrugated or ribbed) tobacco-engaging external surface which reduces the likelihood of slippage of such surface relative to the adjacent tobacco particles 12. The downwardly sloping tobacco-engaging reach 39*a* of the endless flexible element 39 is driven to advance in the direction of the arrow 39*b*, i.e., in a direction to propel the adjacent particles 12 toward the rear portion 14*e* of the upper reach of the lower compacting conveyor 14. The angle alpha (see FIG. 1) between the upper reach of the conveyor 14 and the reach 39*a* is an oblique angle, preferably an acute angle which may equal or approximate 45 degrees. For reasons which will be explained hereinbelow, the angle alpha can be varied to change the inclination of the reach 39*a* with respect to the rear portion 14*e* of the compacting conveyor 14. As a rule, such adjustment will be effected in order to account for certain changes in the characteristics of the processed material, i.e., of tobacco particles 12.

Figure 3:
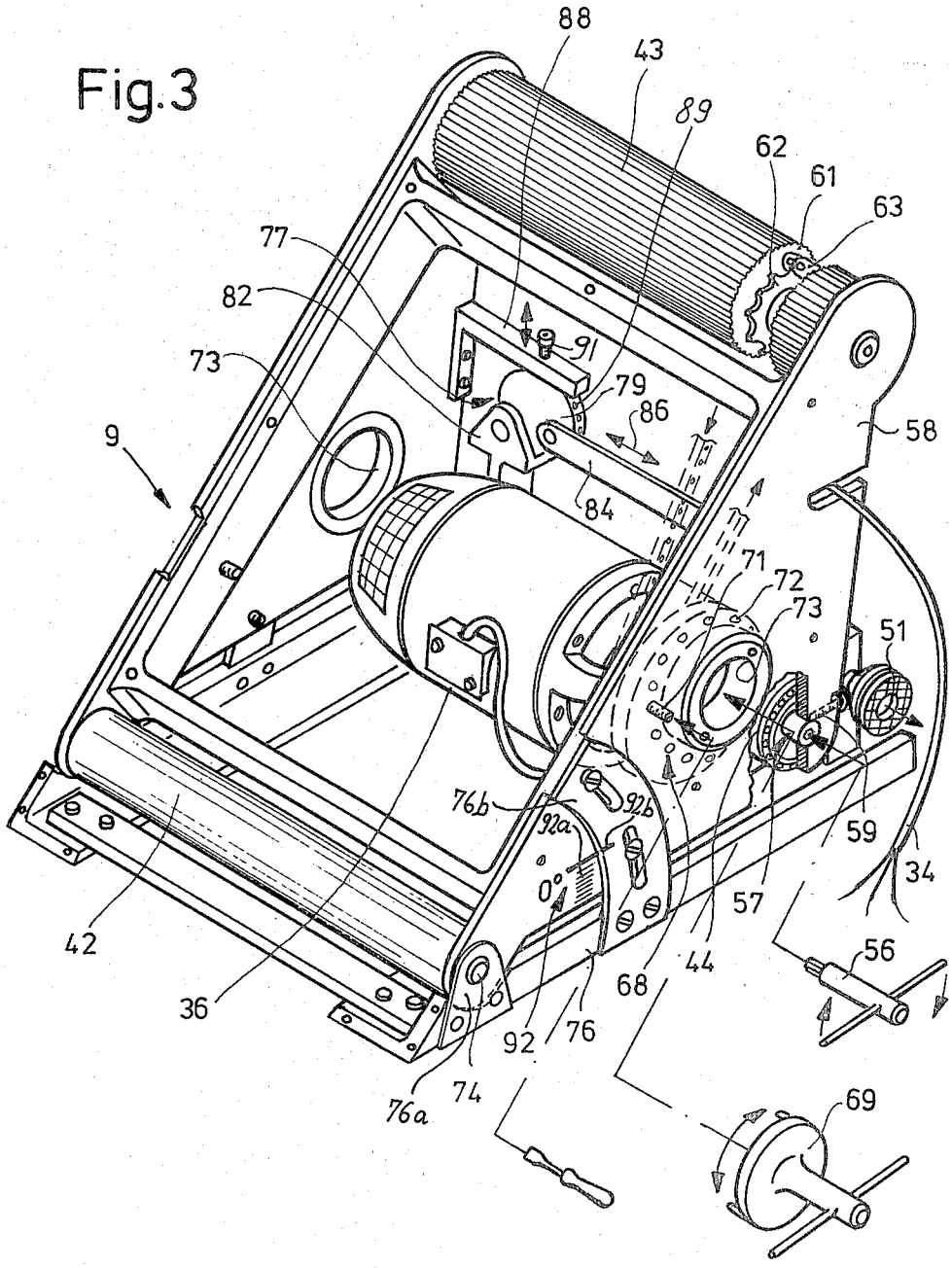
FIG. 3 illustrates the structure of FIG. 2 but with a portion of the casing of the unit broken away.
Figure 4:
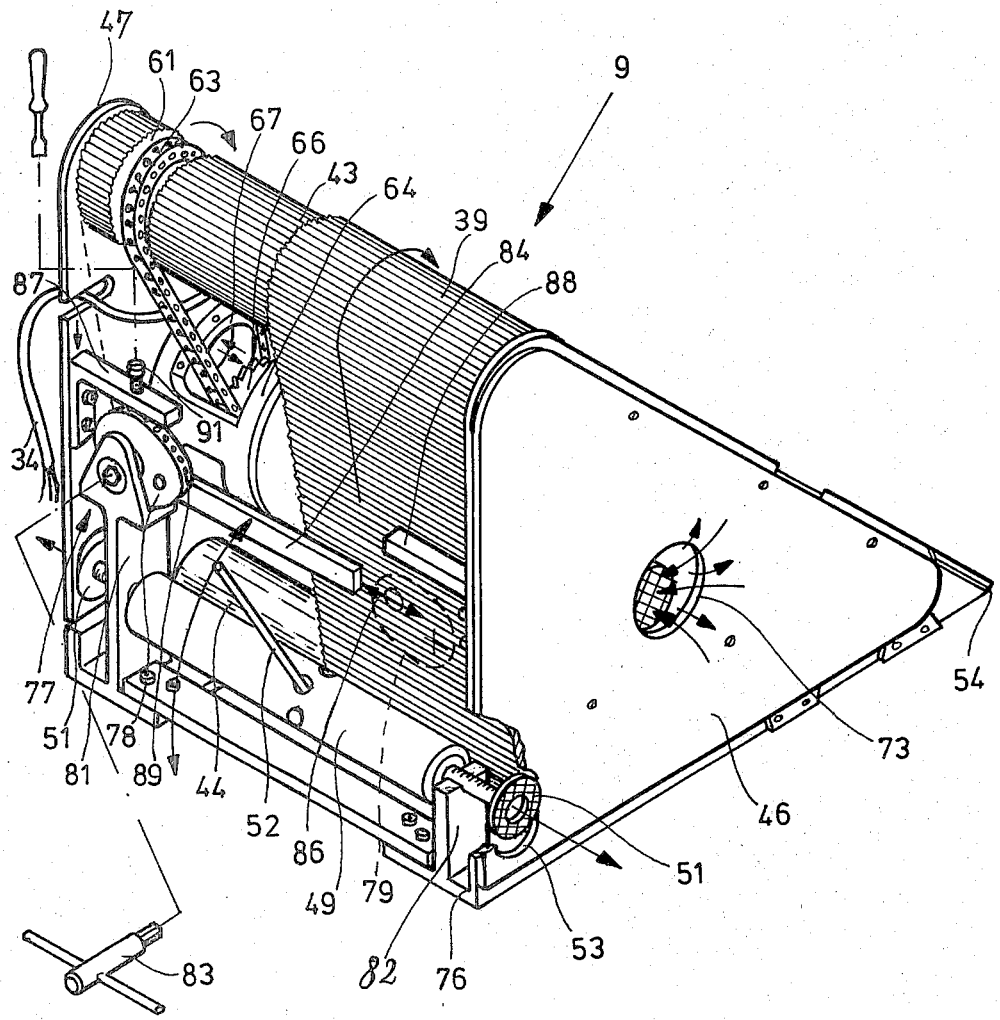
FIG. 4 is a perspective rear elevational view of the unit shown in FIGS. 2 and 3, with a portion of the casing broken away.

The downwardly and forwardly sloping reach 39*a* of the flexible element 39 travels in front of a similarly or identically inclined plate-like back support 41 and is trained over three pulleys in the form of elongated rotary members or rolls 42 , 43 and 44. The prime mover 36 is installed in the space which is surrounded by the endless flexible element 39. The unit 48 which is shown in FIGS. 2, 3 and 4 constitutes a first portion of the duct 1 a second portion of which includes the rake 8, the panel 11, the front wall 2 and the side walls 3, 4. This second portion separably (removably) receives the first portion or unit 48, i.e., the latter constitutes a self-sustaining support or insert which can be assembled independently of other parts of the duct 1 and can be installed in or removed from the operative position shown in FIG. 1.

The axes of the pulleys 42, 43, 44 are parallel to each other, and these pulleys are disposed at the three corners of a triangle (e.g., a right-angled triangle).

The support or insert 48 further includes two lateral panels 46 and 47 which flank the endless flexible element 39 and are disposed in parallel vertical planes. The back support 41 and the panels 46, 47 constitute component parts of a casing which, in turn, constitutes a component of the insert 48 and supports the flexible element 39 as well as the prime mover 36. The manner of separably but securely installing the insert 48 in the second portion of the duct 1 is illustrated in FIG. 4. Thus, the aforementioned casing is provided with a horizontal feed screw 49 which can be rotated by a lever 52 or any other suitable means and carries elastic abutment means in the form of pads 51 which move apart when the feed screw is rotated in one direction but move toward each other when the feed screw is rotated in the opposite direction. The elastic pads 51 can be caused to bear against the inner sides of the respective side walls 3 and 4 to thereby fixedly hold the insert 48 in the selected position, namely, so that the reach 39*a* of the flexible element 39 directs the oncoming (descending) particles 12 of tobacco leaves toward and onto the rear portion 14*e* of the upper reach of the lower compacting conveyor 14. The feed screw 49 is installed close to the lower rear portion of the insert 48, i.e., close to the pulley 44. FIG. 4 shows that the feed screw 49 is readily accessible so that it can be rotated through the medium of the lever 52. To this end, the median portion of the feed screw 49 resembles a cylinder with an annulus of sockets for one end portion of the lever 52 which may constitute an elongated bar of round or other suitable stock. The feed screw 49 has two sets of oppositely inclined threads and each set of threads meshes with the internally threaded nut-like portion of the corresponding elastic pad 51. This causes the pads 51 to move in opposite directions whenever the feed screw 49 is rotated. The lateral panels 46 and 47 of the casing of the insert 48 are formed with suitable apertures or cutouts 53 which allow for expulsion of the pads 51 from or retraction of the pads 51 into the interior of the casing forming part of the insert.

An apron 54 at the lower end of the downwardly sloping tobacco-engaging portion or reach 39*a* of the flexible element 39 bridges the gap between the deflecting conveyor 9 and the rear portion 14*e* of the upper reach of the lower compacting conveyor 14 so as to positively prevent particles of tobacco from penetrating between the conveyors 14 and 9, i.e., between the insert 48 and the rear portion 14*e*. The particles 12 above the portion 14*e* are likely to exhibit the tendency to move in a direction away from the mouthpiece 23 as a result of conversion of the dense shower-like body of particles 12 in the lower part of the duct 1 into the rear portion of the cake in the channel CH.

The insert 48 further includes preferably adjustable means for maintaining the endless flexible element 39 under requisite tension. As shown in FIG. 3, the pulley 44 can constitute a tensioning means for the flexible element 39. To this end, the pulley 44 is movable sideways in the casing of the insert 48. The shaft for the pulley 44 has two eccentric end portions or trunnions 57 which are installed in the lateral panels 46, 47 and whose angular positions can be changed by a tool 56 to thereby change the distance between the pulley 44 and the other two pulleys 42, 43, i.e., to change the tension of the flexible element 39. If desired, the trunnions 57 of the shaft for the pulley 44 can be mounted in a discrete bearing frame 58 (shown in FIG. 3) within the confines of the casing including the lateral panels 46 and 47. Screws 59 or other suitable means are provided to lock the trunnions 57 in selected angular positions. It goes without saying that the illustrated means for changing the position of the pulley 44 relative to the pulleys 42, 43 and for thereby adjusting the tension of the flexible element 39 constitutes but one of a wide variety of means which can increase or reduce the tension of the element 39. Furthermore, the insert 48 can comprise means for moving the pulley 42 and/or 43 relative to the pulley 44, a first adjusting device which effects sidewise movements of the pulley 44, a different sound adjusting device for the pulley 42 and/or a different third adjusting device for the pulley 43. All that counts is to equip the insert 48 with suitable (readily accessible, simple and compact) means for adjusting the tension of the flexible element 39. It will also be appreciated that such adjusting means is or are optional because the flexible element 39 can be installed in properly tensioned position and the tension of such properly installed flexible element can thereupon remain unchanged.

The prime mover 36 transmits motion to the flexible element 39 through the medium of one of the pulleys, in the embodiment of FIGS. 2 to 4 via pulley 43. As shown in FIG. 3, the pulley 43 has a circumferential groove 61 which is adjacent to one of its ends and allows for installation of a gear or sprocket wheel 62. An endless chain 63 is trained over the sprocket wheel 62 and over a second sprocket wheel 66 (see also FIG. 4). The latter is installed in the housing 64 of the prime mover 36 and receives torque from the output element (not specifically shown). The housing 64 has cutouts or other suitable openings 67 for the chain 63. The chain 63 can be tensioned by changing the position of the motor housing 64 relative to the casing of the insert 48. The groove 61 is concealed by the flexible element 39. As shown in FIG. 3, the housing 64 has an eccentric portion 68 which is installed in the aforementioned frame 58 for the trunnions 57 of the tensioning pulley 44. The eccentric portion 68 is disposed at one axial end of the prime mover 36 and its angular position (and hence the tensioning of the chain 63) can be changed by resorting to a suitable tool 69 shown in the lower right-hand portion of FIG. 3. A locking pin 71 is removably inserted into the frame 57 to normally hold the eccentric portion 68 in a selected angular position. The portion 68 has an annulus of sockets 72 and the locking pin 71 extends into one of these sockets, depending on the selected angular position of the eccentric portion 68.

The insert 48 is preferably further provided with means for removing heat which is generated by the prime mover 36 and/or to supply one or more currents of gaseous coolant (preferably air). In the simplest way, heat which is generated in response to operation of the prime mover 36 can be permitted to escape by providing the frame 58 and/or the lateral panels 46, 47 with holes 73 for circulation of cool atmospheric air. Arrows in the right-hand portions of FIGS. 2 and 4 denote the inflow of cool atmospheric air and the outflow of hot air from the interior of the insert 48.

The means for changing the inclination of the downwardly sloping tobacco-engaging reach 39*a* of the flexible element 39 relative to the rear portion 14*e* of the upper reach of the lower compacting conveyor 14 (i.e., for changing the aforediscussed angle alpha) includes means for pivoting the frame 58 (which carries the pulleys 43 and 44) about the axis of the pulley 42 (see particularly FIG. 3). Thus, the frame 58 can be pivoted clockwise or counterclockwise, as viewed in FIG. 3, in order to change the inclination of the reach 39*a* and hence the angle alpha within a desired range. The frame 58 has two coaxial studs or pins 74 which are turnable in bearing members or lugs 76*a* forming part of a bottom portion 76 of the casing of the insert 48. The insert 48 is preferably further provided with means 77 for pivoting the frame 58 about the common axis of the studs 74 (these studs may but need not be exactly coaxial with the pulley 42 for the flexible element 39). The pivoting means 77 is installed at the rear side of the insert 48 (i.e., at that side which is adjacent to the lower portion of the panel 11, provided that the panel 11 extends all the way to the upper reach of the lower compacting conveyor 14). The illustrated pivoting means 77 includes two cams 78 and 79 which are respectively adjacent to the panels 47 and 46 and resemble discs which are turnably mounted in carriages 81 and 82. These carriages further constitute bearings for the aforediscussed feed screw 49 which carries the elastic pads 51 for detachable mounting of the insert 48 in the second portion of the duct 1, i.e., between the side walls 3 and 4. One of the cams, e.g., the cam 78, can be rotated by a suitable tool or wrench 83 (shown in the lower left-hand portion of FIG. 4). The angular movement of the cam 78 is shared by the cam 79 because the two cams are coupled to each other by a link 84, i.e., all angular movements which the cam 78 is caused to perform in response to application and turning of the tool 83 (the link 84 then moves in one of the directions indicated by a double-headed arrow 86) are shared by the cam 79.

The peripheral surfaces of the cams 78, 79 respectively contact strip-shaped followers 87 and 88 which are secured to the frame 58 so that the configuration of such peripheral surfaces or cam faces, together with the extent of angular displacement of the cams 78 and 79, determines the extent to which the angle alpha is changed. At least one of the cams 78, 79 is formed with an annulus of substantially radial bores or sockets 89 which are machined into its peripheral surface or cam face (see FIG. 4). One of these sockets can receive a locking pin 91 which is slidable in a through hole of the follower 87 or 88 on the frame 58. Other means for arresting the cams 78, 79 in selected angular positions can be provided with equal advantage; for example, the insert 48 can be provided with means for releasably locking the cam 79 and/or for locking the link 84.

The means 92 for indicating the selected angular position of the frame 58 (i.e., the selected magnitude of the angle alpha) includes a suitably graduated scale 92*a* on the frame 58 and an index or pointer 92*b* on an arcuate member 76*b* which is separably attached to the bottom portion 76 of the casing of the insert 48.

Figure 5:
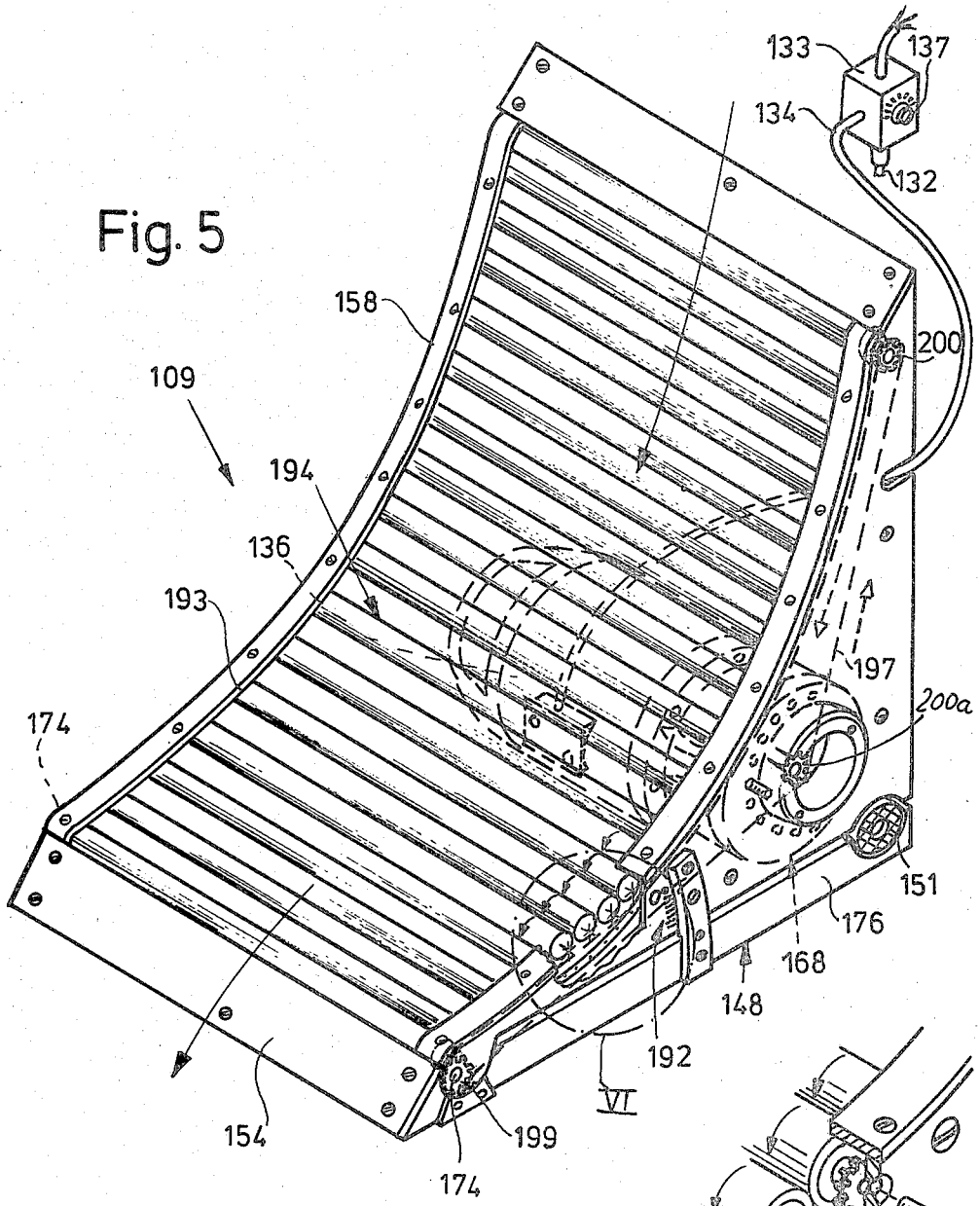
FIG. 5 is a perspective view of a modified unit.

FIG. 5 illustrates a modified insert 148 including a deflecting conveyor 109 which can be used as a substitute for the insert 48 with the conveyor 9. All such parts of the structure shown in FIGS. 5 and 6 which are identical with or clearly analogous to corresponding parts of the insert 48 are denoted by similar reference characters plus 100. The endless flexible element 39 of the deflecting conveyor 9 is replaced with a roller conveyor having a series of closely adjacent parallel elongated rollers 193 each of which is driven to rotate about its own axis. The end portions of the rollers 193 are installed in the frame 158 so that they together form what can be called a concave track 194 along which the particles of tobacco advance on their way from the interior of the duct into the channel between the compacting conveyors. Slight or even reasonably pronounced concavity of the track 194 is desirable and advantageous because it contributes to satisfactory deflection of oncoming tobacco particles from a substantially vertical into a substantially horizontal path.

Figure 6:
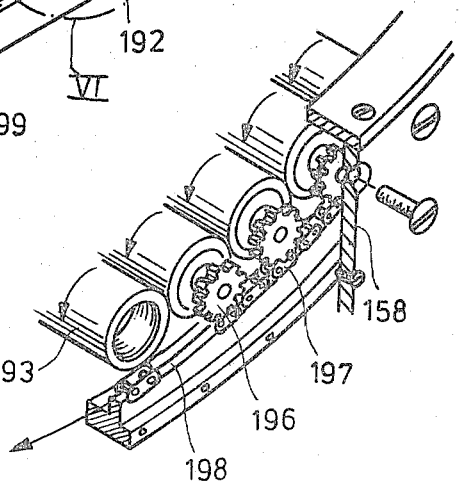
FIG. 6 is an enlarged view of a detail within the phantom-line circle VI of FIG. 5.

As shown in FIG. 6, the drive means for rotating the rollers 193 about their respective axes comprises discrete gears or pinions 196, one for each roller 193. These pinions mesh with the adjacent stretch of an endless chain 197 (which can be replaced with a toothed belt). The chain 197 is guided by the concave surface of a guide rail 198 whose concavity matches and determines that of the aforementioned track 194. As shown in FIG. 5, the chain 197 is trained over sprocket wheels 199, 200 the former of which is mounted on or coaxial with one of the studs 174. The other sprocket wheel (200) is mounted at the upper end of the insert 148, and the chain 197 is further trained over a driver sprocket wheel 200*a* on the output element of the variable speed prime mover 136. The tension of the chain 197 can be changed in the same way as described in connection with the chain 63, i.e., by changing the angular position of the housing portion 168 of the prime mover 136 relative to the casing of the insert 148.

The inclination of the track 174 relative to the upper reach of the lower compacting conveyor (not shown in FIGS. 5 and 6) can be changed in a manner similar to that described for the changes of inclination of the tobacco-engaging reach 39*a* of the flexible element 39 shown in FIGS. 1 to 4. Thus, the angular positon of the frame 158 relative to the stationary bottom portion 176 of the casing of the insert 148 can be changed by pivoting the frame 158 about the common axis of the studs 174.

The manner in which the speed of the prime mover 136 can be varied is also analogous to the manner of varying the speed of the aforediscussed prime mover 36 for the endless flexible element 39. Thus, the RPM of the rollers 173 is varied in response to changes in the width of the opening between the two sections of the mouthpiece in the cutting machine which embodies the insert 148.

The insert 148 exhibits the additional advantage that it allows for rotation of selected rollers 193 at different speeds. Thus, the track 194 can be assembled of at least two groups or sets of rollers 193 including a set of larger-diameter rollers and a set of smaller-diameter rollers. If the pinions 196 for all rollers are identical, the peripheral speed of larger-diameter rollers will exceed the peripheral speed of smaller-diameter rollers. Also, certain rollers can carry larger pinions 196 and certain other rollers can carry smaller pinions. This, too, contributes to the assembly of a deflecting conveyor certain portions of which advance tobacco particles at different speeds i.e., of a deflecting conveyor wherein at least one first portion advances or propels tobacco particles at a higher speed while one or more additional portions of the same conveyor simultaneously propel tobacco particles at one or more different speeds.

If the speed of rollers in several portions of the track 194 is different, the rollers (e.g., fifty percent of the total number of rollers) whose peripheral speed is higher are preferably placed nearer to the outlet of the duct, i.e., at the upper end of the track 194. This ensures that the mass of tobacco particles which descend from the duct undergoes a gradual preliminary densification or compression on their way toward the channel between the two compacting conveyors. Moreover, such selection of speeds of the rollers 193 even further reduces the likelihood of development of voids in the region where the direction of tobacco particles is changed during transfer from the duct into the channel between the compacting conveyors.

An important advantage of the improved apparatus is that the density of the cake in the channel between the compacting conveyors is more uniform than in heretofore known cutting or shredding machines, even if one or more variable parameters which can adversely influence the density of the cake fluctuate within a rather wide range. As mentioned above, such parameters include the composition of tobacco (particularly when the tobacco which is supplied to the duct is a blend of two or more different types of tobacco), the moisture content of tobacco, the temperature of tobacco and the speed at which the compacting conveyors advance the cake toward the comminuting station. The improved densifying effect is achieved by the expedient of selecting the speed of the deflecting conveyor 9 or 109 so that it exceeds, and preferably greatly exceeds, the speed of the compacting conveyor means. The width or height of the opening between the sections 21 and 22 of the mouthpiece 23 will fluctuate very little if the speed of the deflecting conveyor is much higher than the speed of the compacting conveyors, i.e., if the speed of the deflecting conveyor is a multiple of the speed of the conveyors 13 and 14. This reduces the effects of possible slippage of tobacco particles as a result of impact against the rapidly moving deflecting conveyor 9 or 109 on the formation of rear portion of the cake above the portion 14*e* of the upper reach of the compacting conveyor 14. Experiments with the improved apparatus prove that the selection of the speed of the flexible element 39 or of the peripheral speed of the rollers 173 in such a way that the speed is approximately or exactly three times the speed of the compacting conveyors 13 and 14 will practically guarantee the formation of a highly satisfactory cake, even under circumstances, which, in conventional tobacco shredding machines, would result in the formation of a cake with pronounced voids or with portions of very high and portions of much lower density. The aforediscussed angle alpha of approximately 45 degrees between the tobacco engaging reach 39*a* of the flexible element 39 or the track 174 on the one hand, and the upper reach of the compacting conveyor 14 on the other hand, also contributes to the formation of a highly satisfactory cake because such (or a similar) angle ensures proper guidance of tobacco particles in the region which is immediately adjacent to the insert 48 or 148.

The assembly of a self-sustaining insert 48 or 148 is desirable and advantageous because such insert can be installed in certain types of existing tobacco cutting machines as well as for many other reasons such as convenience of inspection or repair, convenience of cleaning, convenience of adjustment of tension of the endless flexible element or elements and/or adjustment of the inclination of the deflecting conveyor (angle alpha). The provision of the feed screw 49 and pads 51 or analogous means for releasably or separably installing the insert 48 or 148 in the second portion of the duct also contributes to convenience of manipulation of the insert and reduces losses in output when the machine is to be converted for the processing of different types of tobacco.

The placing of the prime mover 36 or 136 into the space within the confines of the flexible element 39 or within the confines of the frame 158 which carries the rolls 193 of FIGS. 5 and 6 contributes to compactness of the insert 48 or 148, and such arrangement also ensures that the prime mover is shielded from adverse effects of foreign matter, such as tobacco dust. The provision of a downwardly sloping track consisting of closely adjacent parallel rollers (193) as well as the training of the flexible element 39 around three pulleys (42–44) also contributes to compactness and simplicity of the respective insert.

The angle alpha is varied (when necessary) for reasons which were discussed hereinbefore. Furthermore, such angle can be changed for other reasons in addition to or instead of the aforediscussed reasons. For example, the operator may decide to change the friction between the descending particles of tobacco and the deflecting conveyor by the simple expedient of increasing or reducing the angle alpha. This can compensate for changes in consistency of tobacco (e.g., relatively moist particles are more likely to frictionally engage (cling to) the belt or band-like element 39 or to the rollers 193 than relatively dry particles). Also, the operator may wish to change the angle alpha if the material which fills or partially fills the duct contains a relatively high percentage of heavier particles such as fragments or ribs, stem and/or birds' eyes which exhibit a more pronounced tendency to rebound on impact against the deflecting conveyor. The indicating means 92 or 192 enables the attendant or attendants to rapidly select an optimum angle alpha for any one of a large number of different operating conditions and tobacco types. For example, the scale of the indicating means can be provided with suitable indicia denoting optimum magnitudes of the angle alpha for the processing of moist tobacco, for the processing of tobacco ribs, for the processing of pure or nearly pure tobacco leaf laminae, etc. Pivotal mounting of the frame 58 or 158 in the casing of the insert 48 or 148 has been found to be an especially simple and convenient expedient to facilitate rapid and accurate adjustments of the angle alpha. The cams 78, 79 for effecting adjustment of the angular position of the frame relative to the casing of the insert are optional; however, they, too, contribute to convenience of manipulation, i.e., to convenient and accurate adjustment or change of the angle alpha with minimal losses in time.

The utilization of one of the pulleys 42–44 as a tensioning means for the flexible element 39 in the insert 48 of FIGS. 1–4 also contributes to compactness of the insert, i.e., the pulley which constitutes the tensioning means simply performs an additional function, namely, a function in addition to its main purpose of guiding the flexible element 39 along a predetermined path. The placing of the prime mover 36 or 136 into the interior of the deflecting conveyor (or into the interior of the frame of the insert) also contributes to compactness of the insert in addition to the previously mentioned advantages, such as shielding of the prime mover from the contaminants which are likely to be present in the atmosphere within a tobacco processing plant. Furthermore, and even though the chain which receives motion from the prime mover 36 or 136 could be tensioned in a number of different ways, the tensioning of such chain by the expedient of shifting the position of the motor housing relative to the casing of the insert 48 or 148 constitutes an additional simplification of the design of the insert and contributes to a reduction of its dimensions and weight.

The utilization of a concave track (194) which is defined by the components (rollers 193) of the deflecting conveyor 109 constitutes a further improvement which contributes to optimum manipulation of tobacco particles in the critical region where the direction of such particles must be changed quite drastically from a vertical or nearly vertical into a horizontal or nearly horizontal path. It goes without saying that, at least for certain applications, the rollers 193 can be installed in such a way as to form a flat or plane track or path for deflection of tobacco particles. Also, the marginal portions of the tobacco-engaging reach 39*a* of the flexible element 39 can be guided in suitable grooves of the casing of the insert 48 so that the reach 39*a* will present a concave side to the particles 12 which descend in the duct 1 and are about to be deflected into the channel CH.

A further important advantage of the improved apparatus is that it renders it possible to maintain the width of the opening between the sections 21 and 22 of the mouthpiece 23 at a constant value without necessitating variations in the speed of the prime mover means (14*d*) for the compacting conveyors 13, 14 or for the compacting conveyors and the holder 26. As explained above, the width or height of the opening between the sections 21 and 22 of the mouthpiece 23 can and normally does greatly influence the quality of shreds SH. Such width can remain constant or nearly constant even if the condition of tobacco and/or certain other parameters vary so that they would normally entail a movement of the section 21 toward or away from the section 22. By adjusting the speed of the deflecting conveyor 9 or 109, one can maintain the width of the aforementioned opening at or close to the optimum value without interfering with the drive means for the compacting conveyors, i.e., without changing the speed of the prime mover means 14*d* and without changing the speed of the holder 26 for the orbiting knives 24 of the tobacco cutting machine.

In its simplest form, the control unit 33 or 133 can be designed solely for manipulation by hand, i.e., by way of the knob 37 or 137 which is surrounded by a suitable scale to facilitate manual adjustment. Thus, the operator can observe a scale or like means which indicates changes in the position of the section 21 relative to the section 22 of the mouthpiece 23, and the control unit 33 or 133 is then adjusted by hand so as to ensure that the change in the speed of the prime mover 36 or 136 reflects the deviation of the width of the opening between the sections 21 and 22 from an optimum width. Automatic adjustment of the speed of the prime mover 36 or 136 in the aforedescribed manner or in any other suitable manner is preferred at this time because it reduces the likelihood of belated or inaccurate adjustment, especially when the width of the opening which is defined by the mouthpiece 23 is changed abruptly, for example, in response to sudden changes in the speed of the compacting conveyors 13, 14 and/or holder 26. Such sudden changes can take place in many presently known tobacco cutting apparatus wherein the speed of the drive means for the holder 26 and/or conveyors 13, 14 depends on the height of tobacco pile in the duct 1. In the absence of automatic adjustment of the speed of the deflecting conveyor 9 or 109 in response to movement of the mouthpiece section 21 toward or away from the mouthpiece section 22, the width of the opening which is defined by the mouthpiece 23 would change and would remain changed in response to each change in the speed of the prime mover means for the compacting conveyors and/or holder 26. The novel automatic regulating means for the speed of the deflecting conveyor prevents abrupt and/or detectable or consequential deviations of the width of the opening between the mouthpiece sections 21 or 22 from a desired or optimum value in the absence of any supervision on the part of attendants and much more rapidly and more accurately than if the adjustment were carried out by hand. Moreover, the automatic regulating means for the speed of the deflecting conveyor 9 or 109 is not only unlikely to react but also incapable of reacting in response to contradictory signals which could cause a continuous or frequent alternating widening and narrowing of the opening between the mouthpiece sections 21 and 22.

The main purpose of the oscillating rake 8 is to ensure predictable delivery of tobacco particles 12 from the supplying means, through the upper part of the duct 1 and into the range of the deflecting conveyor 9 or 109, or directly onto the upper reach of the lower compacting conveyor 14.

At least some presently known tobacco cutting or shredding machines are equipped with feeding apparatus which can ensure adequate or fairly adequate delivery of tobacco particles in the region close to the front wall of the duct. The improved apparatus, with its rapidly driven deflecting conveyor 9 or 109, not only ensures adequate transport of tobacco particles along the front wall 2 of the duct 1 but also in each and every zone of the duct including the rearmost zone where the particles must travel (at least during certain stages of their descent) at a greatly increased speed in order to catch up with the particles which advance along the front wall 2. This will be readily appreciated since the path of a particle 12 which descends close to the front side of the rake 8 and thereupon along the downwardly sloping reach 39*a* of the flexible element 39 shown in FIG. 1 is much longer than the path of a particle which descends immediately behind the front wall 2 and reaches the rear end portion of the cake in the channel CH without ever coming close to the deflecting conveyor 9. The cake which is formed in the apparatus of the present invention is free of voids and the fluctuations of density in different zones of such cake are minor or negligible, even if the rate at which the duct 1 receives particles of tobacco is not constant. Therefore, the width of the opening between the mouthpiece sections 21 and 22 remains practically constant in spite of often irregular delivery of tobacco particles into the duct 1. Since the adjustment of the speed of the deflecting conveyor 9 or 109 can ensure that the width of the opening between the mouthpiece sections 21 and 22 remains constant regardless of changes in one or more variable parameters which normally influence the position of the upper mouthpiece section in conventional cutting machines, the quantity of shredded tobacco in the machine which embodies the improved apparatus remains constant regardless of the selected output of the apparatus, and this can be accomplished without intentionally changing the speed of the drive means for the knives 24 and/or compacting conveyors 13 and 14. This greatly reduces the quantity of unsatisfactory shreds which are normally produced during the acceleration or deceleration stage of the compacting conveyors as well as during acceleration or deceleration of the holder 26. Moreover, and as already stated above, regulation of the width of the opening between the mouthpiece sections 21 and 22 by the simple expedient of changing the speed of the deflecting conveyor 9 or 109 (and hence the rate of delivery of tobacco particles onto the rear portion 14e of the upper reach of the lower compacting conveyor 14) renders possible a fully automatic compensation for changes in the mixture of tobacco particles, of the width of shreds SH, of the temperature of tobacco, of the moisture content of tobacco, of the output of the machine and/or a combination of such variables without any other adjustments, especially without any changes in the speed of the holder 26 and/or compacting conveyors 13, 14 for the sole or express purpose of maintaining the width of the opening between the mouthpiece sections 21 and 22 at a constant value. In other words, the novel regulation of the width of the opening which is defined by the mouthpiece 23 through the medium of the variable-speed prime mover means 36 or 136 renders it possible to prevent variations in the rate of tobacco delivery to the duct 1 from influencing the quality of the product and of otherwise adversely affecting the operation of the cutting or severing machine.

The adjustment of the speed of the prime mover 36 or 136 can be used in addition to customary regulation of the height of the pile of tobacco particles in the duct 1. Thus, if the speed of the prime mover means 36 or 136 is regulatable in the aforedescribed or analogous manner, the level detector means which monitors the height of the tobacco pile in the duct 1 can be used solely to transmit signals which are processed to influence the speed of the holder 26 and/or the speed of the compacting conveyors 13 and 14. On the other hand, when the width of the opening between the mouthpiece sections 21 and 22 changes, the improved apparatus merely changes the speed of the deflecting conveyor 9 or 109.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and a variable-speed prime mover for driving said deflecting conveyor at a second speed exceeding said first speed and in a direction to advance particles of tobacco from the interior of said duct toward the receiving end of said channel; and control means for regulating the speed of said prime mover, including means for monitoring a dimension of the cake in the region of said comminuting station and for generating signals denoting the monitored dimension.

2. The apparatus of claim 1, wherein said compacting cnveyors include an upper and a lower endless conveyor and said lower conveyor includes a rear portion extending beyond said upper conveyor, as considered in a direction from the discharging toward the receiving end of said channel, said lower portion of said duct being disposed above said rear portion of said lower conveyor.

3. The apparatus of claim 1, wherein said means for driving said deflecting conveyor includes means for continuously operating said deflecting conveyor to move the particles of tobacco from said duct into said channel.

4. The apparatus of claim 1, wherein said second speed is a multiple of said first speed.

5. The apparatus of claim 4, wherein said second speed is approximately three times said first speed.

6. The apparatus of claim 1, wherein said compacting conveyors include an endless upper and an endless lower conveyor and said lower conveyor has an elongated tobacco-engaging and advancing portion, said deflecting conveyor having an elongated tobacco-engaging and advancing portion making an acute angle with the tobacco-engaging and advancing portion of said lower conveyor.

7. The apparatus of claim 6, wherein said acute angle is approximately 45 degrees.

8. The apparatus of claim 1, further comprising a self-sustaining support for said deflecting conveyor and said drive means for said deflecting conveyor.

9. The apparatus of claim 8, wherein said duct includes a first portion which constitutes said support with said deflecting conveyor and the drive means for said deflecting conveyor, and a second portion which includes said front wall, said second portion separably receiving said first portion.

10. The apparatus of claim 9, wherein said second portion further includes side walls extending from said front wall in a direction away from said station, said first portion being disposed between said side walls.

11. The apparatus of claim 9, further comprising means for separably securing said first portion to said second portion of said duct.

12. The apparatus of claim 1, wherein said deflecting conveyor comprises an endless flexible element and a plurality of rotary members, said flexible element being trained over said rotary members and said rotary members including first, second and third rotary members having parallel axes and disposed at the corners of a triangle.

13. The apparatus of claim 12, wherein said rotary members are pulleys or sprocket wheels.

14. The apparatus of claim 12, wherein said endless flexible element surrounds said drive means for said deflecting conveyor.

15. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station, said conveyors including an upper and a lower conveyor and said lower conveyor having an elongated tobacco-engaging and advancing portion; means for driving at least one of said conveyors at a first speed and in a direction to advance the particles of tobacco entering the channel by way of said receiving end toward and beyond said discharging end; and means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said deflecting conveyor having an elongated tobacco-engaging and advancing portion making an acute angle with the tobacco-engaging and advancing portion of said lower conveyor and said feeding means further comprising means for varying said angle in dependency on different operating conditions and/or tobacco types.

16. The apparatus of claim 15, wherein said means for varying said angle includes means for changing the inclination of said portion of said deflecting conveyor relative to said portion of said lower conveyor.

17. The apparatus of claim 15, further comprising means for indicating the magnitude of said angle.

18. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; and means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said conveyor including an endless flexible element and a plurality of rotary members, said flexible element being trained over said rotary members and one of said rotary members being movable relative to each other rotary member to thereby change the tension of said flexible element.

19. The apparatus of claim 1, wherein said duct includes a first portion including said deflecting conveyor and a second portion including said front wall, said first portion including a frame for said deflecting conveyor, a casing, and means for movably mounting said frame in said casing.

20. The apparatus of claim 19, wherein said mounting means includes means for pivotally mounting said frame in said casing.

21. The apparatus of claim 18, wherein said rotary members are parallel to each other and said one rotary member is movable sideways.

22. The apparatus of claim 1, further comprising a support for said deflecting conveyor and for said means for driving said deflecting conveyor, said means for driving said deflecting conveyor including a prime mover and an endless chain receiving motion from said prime mover and arranged to advance said deflecting conveyor.

23. The apparatus of claim 22, wherein said deflecting conveyor comprises an endless flexible element and a plurality of pulleys installed in said support, said flexible element being trained over said pulleys and one of said pulleys having a sprocket wheel mating with said chain.

24. The apparatus of claim 22, wherein said prime mover includes a housing having a portion movably installed in said support to change the tension of said chain in response to movement of said housing portion relative to said support.

25. The apparatus of claim 1, wherein said deflecting conveyor comprises a plurality of closely adjacent parallel elongated rotary members and the drive means for said deflecting conveyor includes prime mover means operative to rotate said rotary members about their respective axes.

26. The apparatus of claim 25, wherein said rotary members are elongated rollers together constituting a downwardly sloping track for descending particles of tobacco.

27. The apparatus of claim 26, further comprising means for transmitting torque from said prime mover means to said rotary members, said torque transmitting means comprising gears provided on said rotary members.

28. The apparatus of claim 27, wherein said torque transmitting means further comprises an endless chain driven by said prime mover means and mating with said gears.

29. The apparatus of claim 28, further comprising a concave guide for that portion of said chain which meshes with said gears.

30. The apparatus of claim 1, wherein said means for driving said deflecting conveyor includes a variable-speed prime mover.

31. The apparatus of claim 1, further comprising a mouthpiece adjacent to said station and arranged to direct the leader of the cake to said station, said mouthpiece having a first section and a second section which is movable relative to said first section as a function of changes of said dimension, said monitoring means including means for monitoring the distance between said sections of said mouthpiece.

32. The apparatus of claim 31, wherein said control means further comprises means for changing the speed of said prime mover in response to said signals.

33. The apparatus of claim 1, wherein said rear wall further includes an oscillatable member installed at a level above said deflecting conveyor and operative to promote the advancement of tobacco particles toward said channel and said deflecting conveyor.

34. The apparatus of claim 33, wherein said oscillatable member includes a rake having an upper portion pivoted to a stationary part of said duct and a lower portion pivotable about the upper portion thereof and adjacent to said deflecting conveyor.

35. The apparatus of claim 34, wherein said upper portion of said rake is adjacent to said tobacco admitting upper portion of said duct.

36. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; and means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed invariably exceeding said first speed and in a direction to advance particles of tobacco from the interior of said duct toward the receiving end of said channel, and a support including a casing and a frame pivotably mounted in said casing, said means for driving said deflecting conveyor including a prime mover installed in said frame and an endless chain receiving motion from said prime mover and arranged to advance said deflecting conveyor, said prime mover including a housing having a portion movably installed in said support to change the tension of said chain in response to movement of said housing portion relative to said support and said deflecting conveyor being installed in said frame.

37. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station, said conveyors including an upper and a lower conveyor and said lower conveyor having an elongated tobacco-engaging and advancing portion; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said deflecting conveyor having an elongated tobacco-engaging and advancing portion making an acute angle with the tobacco-engaging and advancing portion of said lower conveyor, said duct including a first portion including said front wall and a second portion including said portion of said deflecting conveyor, said portion of said deflecting conveyor being movable relative to said portion of said lower conveyor; means for varying said angle; and means for indicating the magnitude of said angle, including a scale member and a pointer member adjacent to said scale member, one of said members being provided on said deflecting conveyor and the other of said members being provided on said first portion of said duct.

38. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said duct including a first portion including said deflecting conveyor and a second portion including said front wall, said first portion including a frame for said deflecting conveyor, a casing, and means for movably mounting said frame in said casing, said mounting means including means for pivotally mounting said frame in said casing; and means for pivoting said frame relative to said casing to thereby change the inclination of said deflecting conveyor relative to said compacting conveyors in dependency on different operating conditions and/or tobacco types.

39. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said duct including a first portion including said deflecting conveyor and a second portion including said front wall, said first portion including a frame for said deflecting conveyor, a casing, and means for pivotally mounting said frame in said casing; and means for pivoting said frame relative to said casing to thereby change the inclination of said deflecting conveyor relative to said compacting conveyors, including rotary cam means mounted in said casing and follower means tracking said cam means and connected with said frame.

40. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end nearer to said station; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel; and a support for said deflecting conveyor and for said means for driving said deflecting conveyor, said deflecting conveyor comprising an endless flexible element and a plurality of pulleys installed in said support, said flexible element being trained over said pulleys and one of said pulleys having a groove confined within said flexible element, said means for driving said deflecting conveyor including a prime mover, an endless chain receiving motion from said prime mover, and a sprocket wheel installed in said groove and mating with said chain.

41. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel; and a support for said deflecting conveyor and for said means for driving said deflecting conveyor, said support including a casing and a frame pivotally mounted in said casing, said means for driving said deflecting conveyor including a prime mover and an endless chain receiving motion from said prime mover and arranged to advance said deflecting conveyor, said prime mover including a housing having an eccentric turnably mounted in said frame to change the tension of said chain in response to movement of said eccentric relative to said support, said prime mover and said deflecting conveyor being installed in said frame.

42. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjecent to said station; means for driving at least one of said conveyors at a first speed and in a direction to advance the particles of tobacco entering the channel by way of said receiving end toward and beyond said discharging end; and means for feeding particles of tobacco to the receiving end of said channel, including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor and means for driving said deflecting conveyor at a second speed exceeding said first speed and in a direction to advance particles of tobacco from the interior of said duct toward the receiving end of said channel, said deflecting conveyor comprising a plurality of closely adjacent parallel elongated rollers together constituting a downwardly sloping track for descending particles of tobacco, said track having a concave exposed side which is contacted by the descending particles of tobacco and the drive means for said deflecting conveyor including prime mover means operative to rotate said rollers about their respective axes.

43. Apparatus for supplying particles of tobacco to the comminuting station of a tobacco cutting machine, comprising a pair of tobacco advancing and compacting conveyors defining a substantially horizontal channel having a tobacco receiving end remote from and a tobacco discharging end adjacent to said station; means for driving at least one of said conveyors at a first speed and in a direction to advance the particles of tobacco entering the channel by way of said receiving end toward and beyond said discharging end; and means for feeding particles of tobacco to the receiving end of said channel including a substantially upright duct disposed above said channel and having a tobacco admitting upper portion and a tobacco discharging lower portion adjacent to the receiving end of said channel, said duct including a front wall nearer to and a rear wall more distant from said station and said rear wall including a tobacco deflecting conveyor comprising a mobile tobacco advancing portion having a component of movement in said direction, a variable-speed prime mover for driving said mobile portion at a second speed exceeding said first speed to thereby advance particles of tobacco from the interior of said duct toward the receiving end of said channel, control means for regulating the speed of said prime mover including means for monitoring a dimension of the cake in the region of said comminuting station and for generating signals denoting the monitored dimension, and means for varying said component of movement in dependency on different operating conditions and tobacco types.

44. The apparatus of claim 1, wherein said second speed invariably exceeds said first speed.

* * * * *